US011698245B2

(12) United States Patent
Burky

(10) Patent No.: US 11,698,245 B2
(45) Date of Patent: Jul. 11, 2023

(54) STACKABLE PROPELLANT MODULE FOR GAS GENERATION

(71) Applicant: Halliburton Energy Services, Inc., Houston, TX (US)

(72) Inventor: Thomas Earl Burky, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 66 days.

(21) Appl. No.: 17/509,700

(22) Filed: Oct. 25, 2021

(65) Prior Publication Data

US 2022/0042775 A1 Feb. 10, 2022

Related U.S. Application Data

(62) Division of application No. 15/564,472, filed as application No. PCT/US2016/069001 on Dec. 28, 2016, now Pat. No. 11,162,767.

(51) Int. Cl.

| | |
|---|---|
| ***F42B 3/04*** | (2006.01) |
| ***E21B 43/117*** | (2006.01) |
| ***E21B 43/1185*** | (2006.01) |
| ***F42B 3/02*** | (2006.01) |
| *E21B 43/263* | (2006.01) |
| *F42D 1/045* | (2006.01) |

(52) U.S. Cl.

CPC ..... *F42B 3/04* (2013.01); *E21B 43/117* (2013.01); *E21B 43/1185* (2013.01); *F42B 3/02* (2013.01); *E21B 43/263* (2013.01); *F42D 1/045* (2013.01)

(58) Field of Classification Search

CPC ..... F42B 3/00; F42B 3/04; F42D 1/04; F42D 1/045; E21B 43/117; E21B 43/1185; E21B 43/263

See application file for complete search history.

(56) References Cited

U.S. PATENT DOCUMENTS

| | | | | | |
|---|---|---|---|---|---|
| 1,758,358 | A * | 5/1930 | Ennis | F42B 3/02 | 102/317 |
| 4,593,622 | A * | 6/1986 | Fibranz | F42B 3/00 | 102/516 |
| 4,657,089 | A * | 4/1987 | Stout | F42B 3/192 | 102/318 |
| 4,798,244 | A * | 1/1989 | Trost | F42B 3/04 | 102/317 |
| 4,976,318 | A * | 12/1990 | Mohaupt | F42B 3/04 | 166/63 |

(Continued)

FOREIGN PATENT DOCUMENTS

| | | |
|---|---|---|
| CA | 2122842 | 6/1991 |
| GB | 2544616 | 5/2017 |

(Continued)

*Primary Examiner* — Benjamin P Lee

(74) *Attorney, Agent, or Firm* — John Wustenberg; Parker Justiss, P.C.

(57) ABSTRACT

This disclosure provides a stackable propellant module for use inside of a gas generation canister. The modules are designed to enable them to be individually fired rather than as a unitary mass, as done in conventional configurations. This enables the generation of a controlled pressure profile rather than an uncontrolled pressure profile determined by the environmental conditions downhole, such as temperature and pressure.

23 Claims, 5 Drawing Sheets

(56) References Cited

U.S. PATENT DOCUMENTS 5,369,579 A * 11/1994 Anderson ..... F42D 1/04 175/4.54
7,721,650 B2 * 5/2010 Barton ..... F42B 3/10 166/63
8,794,335 B2 * 8/2014 Fadul ..... E21B 43/11 166/376
9,169,695 B1 * 10/2015 Calvert ..... E21B 49/08
9,822,617 B2 * 11/2017 Bird ..... F42B 1/028
10,151,180 B2 * 12/2018 Robey ..... E21B 43/117
2003/0037692 A1 2/2003 Liu
2004/0129415 A1 * 7/2004 Xi ..... E21B 43/116 175/4.6
2008/0103948 A1 5/2008 Schmidt et al.
2010/0212480 A1 * 8/2010 Bell ..... F42B 3/24 89/1.15
2011/0240183 A1 10/2011 Seekford
2013/0118805 A1 * 5/2013 Moody-Stuart ..... E21B 43/116 175/2
2013/0192829 A1 * 8/2013 Fadul ..... E21B 43/117 166/297
2014/0083764 A1 * 3/2014 Fadul ..... E21B 43/117 175/2
2015/0361774 A1 * 12/2015 Flores ..... F42B 1/028 166/297
2017/0052011 A1 * 2/2017 Parks ..... E21B 43/11855
2017/0145798 A1 * 5/2017 Robey ..... E21B 43/117
2020/0284114 A1 * 9/2020 Mahjoub ..... E21B 29/02

FOREIGN PATENT DOCUMENTS

WO 9421882 A1 9/1994
WO 2016079512 A1 5/2016
WO WO-2017014740 A1 * 1/2017 ..... E21B 43/116
WO WO-2017014741 A1 * 1/2017 ..... E21B 43/11

* cited by examiner

STACKABLE PROPELLANT MODULE FOR GAS GENERATION

CROSS-REFERENCE TO RELATED APPLICATION

This application is a divisional of U.S. application Ser. No. 15/564,472, filed on Oct. 5, 2017, entitled "A STACKABLE PROPELLANT MODULE FOR GAS GENERATION," which application is the National Stage of, and therefore claims the benefit of, International Application No. PCT/US2016/069001 filed on Dec. 28, 2016, entitled "A STACKABLE PROPELLANT MODULE FOR GAS GENERATION". The above applications are commonly assigned with this National Stage application and are incorporated herein by reference in their entirety.

BACKGROUND

Creating perforations within a wellbore is a well-known completion practice and with present day technology and equipment, it is relatively easy to achieve. However, creating a low-pressure-drop flow path requires considerably more effort. Most perforations have a crushed zone and other damage mechanisms that hinder production. To improve flow capacity, underbalanced perforating, extreme overbalanced perforating, surging, or one of several breakdown actions is necessary to clean the perforations and improve flow capacity.

In most cases, dynamic positive pressure (overbalance) conditions are often generated in the wellbore environment by burning propellant to rapidly produce gas. The intention is that the rapidly increased pressure and the low viscosity fluid (gas) is to flow into the reservoir and initiate cracks in the rock formation originating from the perforation tunnels. By successfully creating small, "micro" fracture networks, the well is stimulated to some extent and subsequent fracturing of the well is more efficient. Normally, the propellant is initiated by the explosive charges that are also producing the perforations, de facto coupling the timing of the dynamic overbalance (DOB) to the perforation event.

This initiation method is convenient but coupling these two events so closely can result in negative side effects. As mentioned above, the perforation process can result in a substantial amount of debris in the perforation tunnel, as well as a crushed rock zone lining the tunnel. The tunnel debris can block the flow of material in either direction and the crushed zone has extremely low permeability, or high "skin" effect. A strong dynamic underbalance (DUB) can be used to clean the perforation tunnel of one or both of these problems. However, the rapid generation of the gas immediately after the detonation event can interfere with the DUB and prevent tunnel clean up.

DETAILED DESCRIPTION

Figure 1:
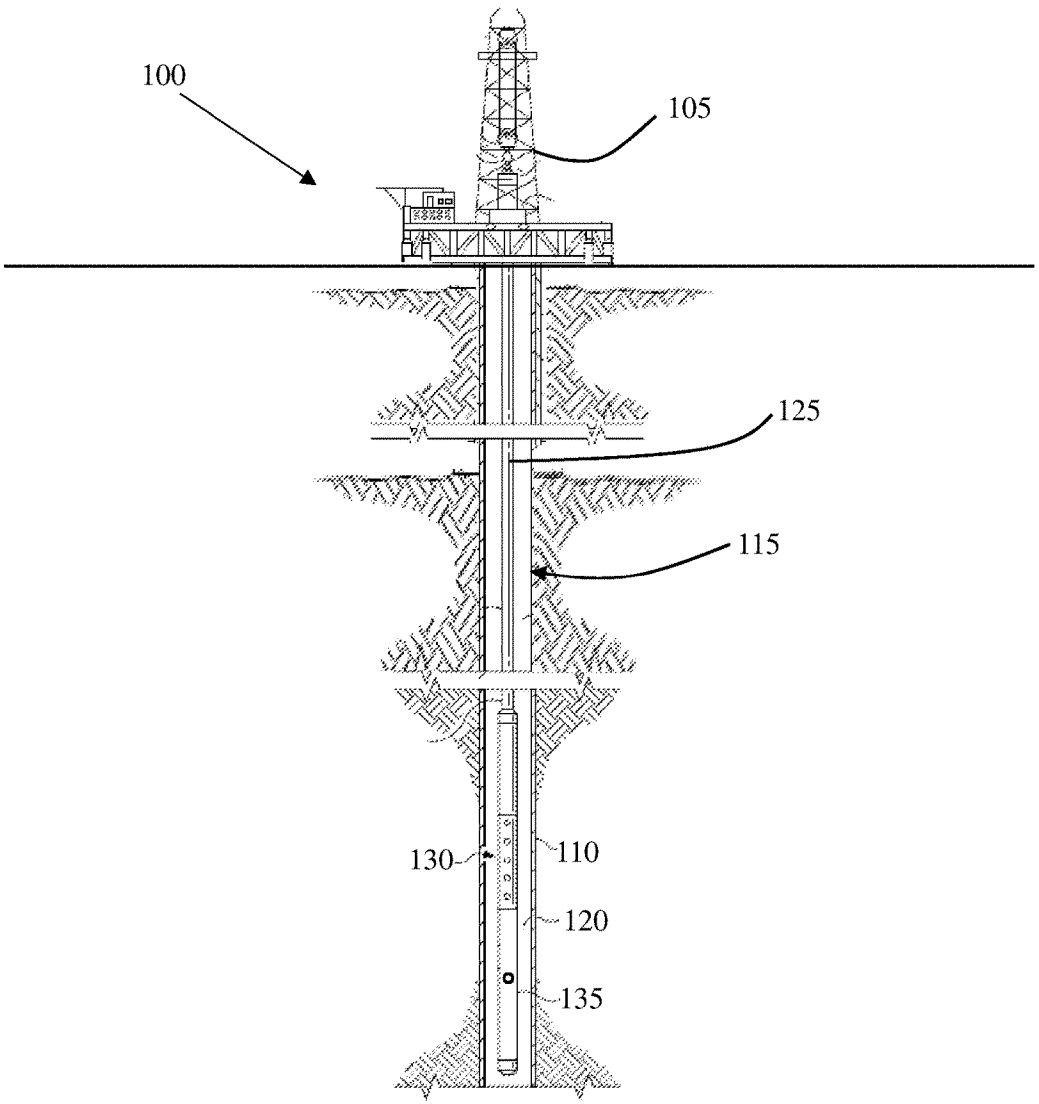
FIG. 1 illustrates a well environment in which the various embodiments of this disclosure might be used.

The relationship of wellbore pressure to formation pressure immediately before and after perforating is a key determining factor in perforation tunnel volume, clean out, and ultimately the flow performance of the well. An optimal pressure time profile relationship is not fixed in that each perforating scenario can have unique factors in terms of pore pressure, wellbore volume, underbalance, overbalance and the preferred rate of change from one condition to the other.

The DOB can interfere with the DUB event such that tunnel clean up may be negatively affected. Conversely, the DUB is also interfering with the DOB event. The implication of this is that the DOB event would not generate any flow or cracks in the formation, and thus fail to produce the benefits of stimulation. The way to correct this situation is to decouple the perforation DUB and DOB events.

This disclosure, in its various embodiments, provides a stackable propellant module for use inside of a gas generation canister. The modules are designed to enable them to be individually fired rather than as a unitary mass, as done in conventional configurations. This enables the generation of a controlled pressure profile rather than an uncontrolled pressure profile determined by the environmental conditions downhole, such as temperature and pressure. This action is intended to occur after the perforating gun detonation event, and in some embodiments, can be actuated by either an on-board sense/analyze/respond logic loop system that is fully autonomous, or from a surface firing system. Benefits include the ability of the field operations to separate the perforation and gas stimulation events for enhanced petroleum production and reduce the risk of damage to wellbore equipment from uncontrolled dynamic pressures.

Conventional systems for downhole applications have used unitary propellant grains, that is, there is only one piece of propellant per gas generator. Once that piece is ignited, it burns at a rate that is determined by its formulation and downhole temperature and pressure conditions. Therefore, the pressure ramp rate cannot be accurately controlled by the user and may result in undesirable downhole conditions. As provided by this disclosure, the propellant is broken up into individual modules, each with an independent igniter that can be fired at controlled times, which provide more accurate control over the pressure ramp rate. Further, this disclosure provides embodiments that allow for the de-coupling of the ignition time of the propellant from the detonation time of the perforating system. Additionally, the propellant modules may be densely packed for optimum efficiency of gun string length and volume.

Thus, the various embodiments of this disclosure allow the stimulation effect that is desired in current propellant applications to be effective, since it can be applied in high density and separated in time from the perforating event. This also provides the autonomous pressure control system for gun string survival that allows for wellbore pressure to be increased only as much as needed, when it is needed.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings; with the understanding that they serve as examples and that, they do not limit the disclosure to only the illustrated embodiments. Moreover, it is fully recognized that the different teachings of the embodiments discussed, below, may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements but include indirect connection or interaction between the elements described, as well. As used herein and in the claims, the phrases, "operatively connected" or "configured" mean that the recited elements are connected either directly or indirectly in a manner that allows the stated function to be accomplished. These terms also include the requisite physical structure(s) that is/are necessary to accomplish the stated function.

In the following discussion and in the claims, the terms "including" and "comprising" are used in an open-ended fashion, and thus should be interpreted to mean "including, but not limited to." Unless otherwise specified, any use of any form of the terms "connect," "engage," "couple," "attach," or any other term describing an interaction between elements is not meant to limit the interaction to direct interaction between the elements but include indirect interaction between the elements described, as well. References to up or down are made for purposes of description with "up," "upper," or "uphole," meaning toward the surface of the wellbore and with "down," "lower," "downward," "downhole," or "downstream" meaning toward the terminal end of the well, as the tool would be positioned within the wellbore, regardless of the wellbore's orientation. Additionally, these terms do not limit the orientations of the device's components with respect to each other. Further, any references to "first," "second," etc. do not specify a preferred order of method or importance, unless otherwise specifically stated, but such terms are intended to distinguish one element from another. For example, a first element could be termed a second element, and, similarly, a second element could be termed a first element, without departing from the scope of example embodiments. Moreover, a first element and second element may be implemented by a single element able to provide the necessary functionality of separate first and second elements.

The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 generally illustrates an exploration system 100 in which the embodiments of the present disclosure may be implemented. A conventional drilling rig 105 is shown, which may be a sea drilling platform or a land platform. At this stage of the drilling operations, a casing 110 has been inserted into the wellbore 115 and cemented into place, which forms a well annulus 120. By way of convention in the following discussion, though FIG. 1 depicts a vertical wellbore, it should be understood by those skilled in the art that embodiments of the apparatus according to the present disclosure are equally well suited for use in wellbores having other orientations including horizontal wellbores, slanted wellbores, multilateral wellbores or the like. Additionally, though a drilling rig 105 is shown, those skilled in the art understand that a work-over rig or truck equipped with a coil tubing or wire line may also be used to operate the embodiments of the apparatus according to the present disclosure. The drilling rig 105 supports a string of tubing 125, which is attached to a conventional perforating gun 130 and an embodiment of an annular pressure control/wellbore gas generation system 135, as discussed below.

Figure 2:
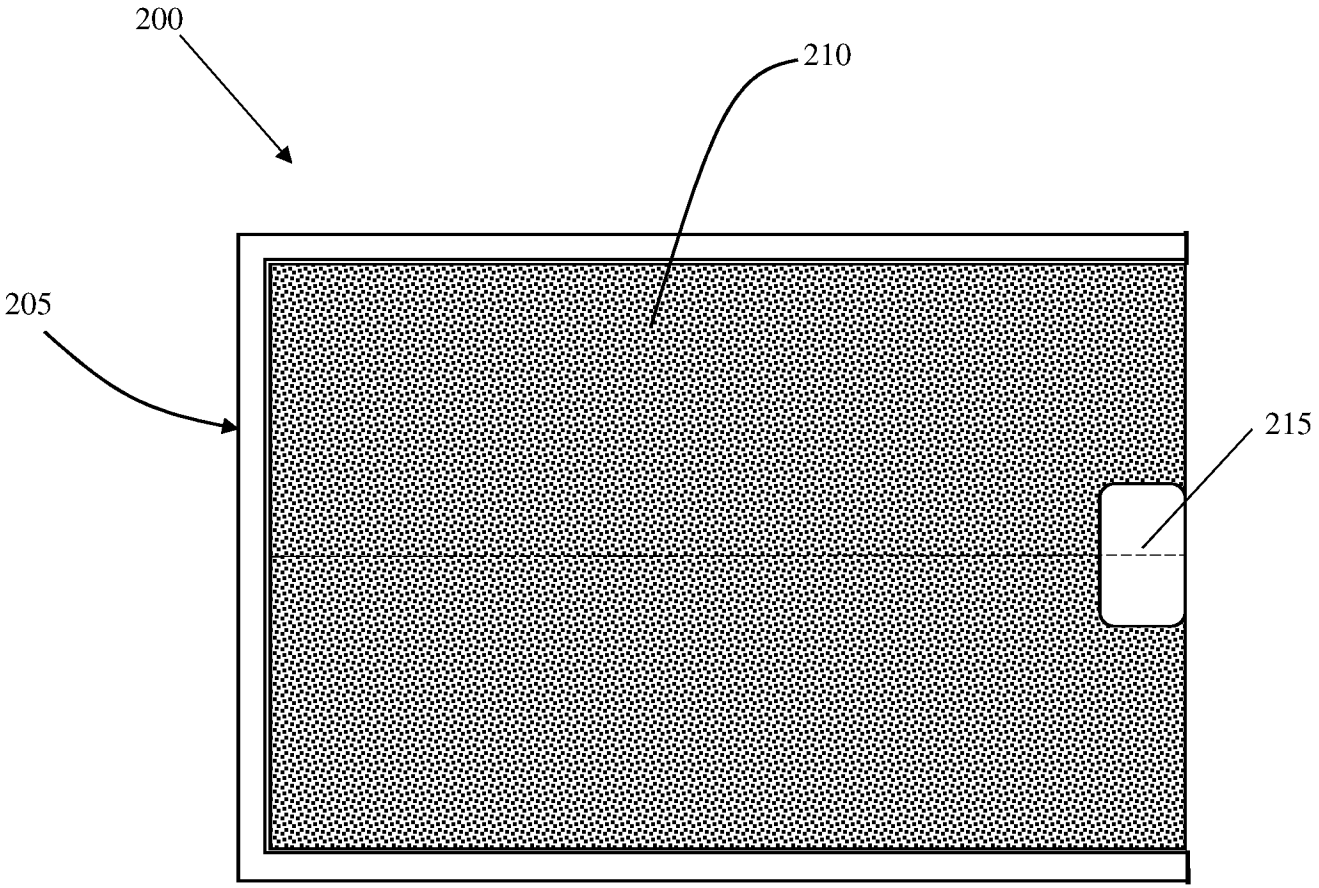
FIG. 2 illustrates an embodiment of a stackable propellant module.

FIG. 2 illustrates a sectional view of one embodiment of a propellant module 200 that may be used in the wellbore gas generation system 135. In this embodiment, the propellant module 200 comprises a housing 205 configured to be inserted into a wellbore gas generation canister (not shown), a propellant 210 contained in the housing 205, and an igniter 215 associated with the housing 205 and positioned to ignite the propellant 210. The housing 205 protects the propellant 210 from the heat and pressure generated by the ignition of an adjacent propellant module 200. The housing 205 is designed to withstand this heat and pressure without inadvertently igniting its propellant until it is signaled to do so. In one embodiment, the housing 205 may be comprised of a stiff material that is able to withstand the ignition of the propellant 210 without disintegrating. For example, the housing 205 may be a metal or metal alloy, or a stiff thermal plastic, or other synthetic material. In one embodiment, the propellant 210 fills a substantial portion of the hollow space of the housing 205, as generally shown. However, it should be noted that different amounts of propellant 210 may be used, depending on the amount of gas and corresponding pressure that is intended to be generated, and in such embodiments, the propellant 210 may fill less space within the housing 205. The propellant 210 may be a conventional explosive or propellant that is conventionally used to generate gas.

The igniter 215 is associated with housing 205, that is, the igniter 215, or a portion thereof, may be contained within the housing and embedded within the propellant 210, as shown, or the igniter 215 may contact the propellant 210 while remaining outside of the housing 205. The igniter 215 can be used to ignite the propellant 210 in a variety of ways, such as through the use of electrical contacts or mechanical percussion. Thus, in some embodiments, the igniter 215 may simply be two electrical leads that extend into the propellant 210, or in another embodiment, it may be a detonator that forms a small explosion within the propellant 210, which then ignites the propellant 210. In one embodiment, the igniter 215 is located on a central longitudinal axis and is embedded within the propellant, as generally shown in FIG. 2.

Figure 3A:
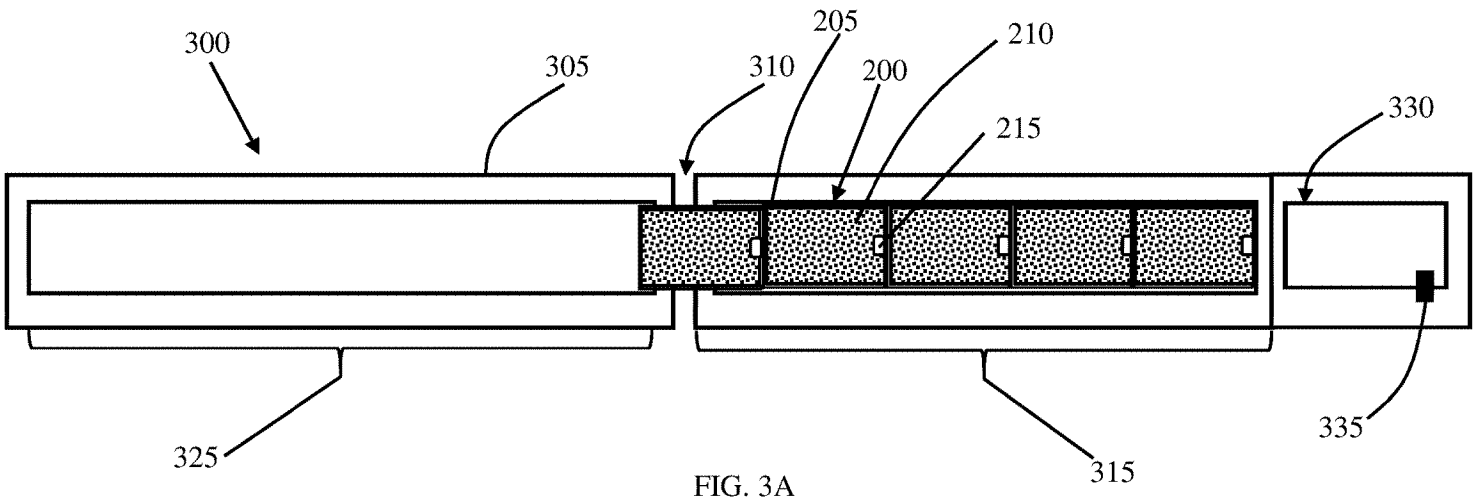
FIG. 3A illustrates a wellbore gas generation system in which an embodiment of the stackable propellant module may be implemented.

FIG. 3A illustrates an embodiment of a wellbore gas generation system 300. The depicted embodiment comprises a gas generation canister housing 305 having at least one or more vent holes 310 located along a length of the gas generation canister housing 305. In one embodiment, where one vent hole 310 is present, it is located at the center of the longitudinal length of the wellbore gas generation system 300, that is, at its axial center. A number of propellant modules 200 (only one of which is labeled for simplicity of illustration) are positioned in a module storage section 315, one of which plugs the vent hole 310 until the propellant 210 is ignited. This embodiment illustrates the wellbore gas generation system 300 prior to being placed in the wellbore.

This embodiment also includes a spent module housing storage section 325 that is positioned to receive the module housing 205 after ignition. When the wellbore gas generation system 300 is positioned in a wellbore, the spent module housing storage section 325 is located downhole from the vent hole 310.

In one embodiment, the wellbore gas generation system 300 includes an electronic control system 330 that may have a built in electrical power supply or an external power supply. The electronic control system 330 is electrically connected, either by hard wire or wirelessly, to the igniter 210 of each of the propellant modules 200 to facilitate transmission of the ignition signal. The igniters 215 of each of the propellant modules 200 has a signal address that the controller system 330 uses to ignite each propellant module 200 individually. The electronic control system 330 is programmed to time the firing of each igniter 215 in real time as it assesses the wellbore pressure conditions. In this way, the propellant modules 200 can be ripple fired with small, directed time delays between each module firing signal so that the desired wellbore pressure rise rate and time can be achieved.

Though the illustrated embodiment shows the electronic control system 330 coupled directly to the wellbore gas generation system 300, it should be understood that in other embodiments, the electronic control system 330 may be remotely coupled to wellbore gas generation system 300. For example, the electronic control system 330 may be located at the surface of the wellbore and be coupled to the wellbore gas generation system 300 by a wire running from the surface to the wellbore gas generation system 300, or they may be coupled wirelessly.

In one embodiment, the wellbore gas generation system 300 may also include a pressure sensor 335 and other sensors, such as temperature sensors (not shown). The pressure sensor 335 is coupled to the electronic control system 330 and supplies pressure data to the electronic control system 330 that allows the electronic control system 330 to maintain the desired amount of pressure within the wellbore gas generation system 300.

Figure 3B:
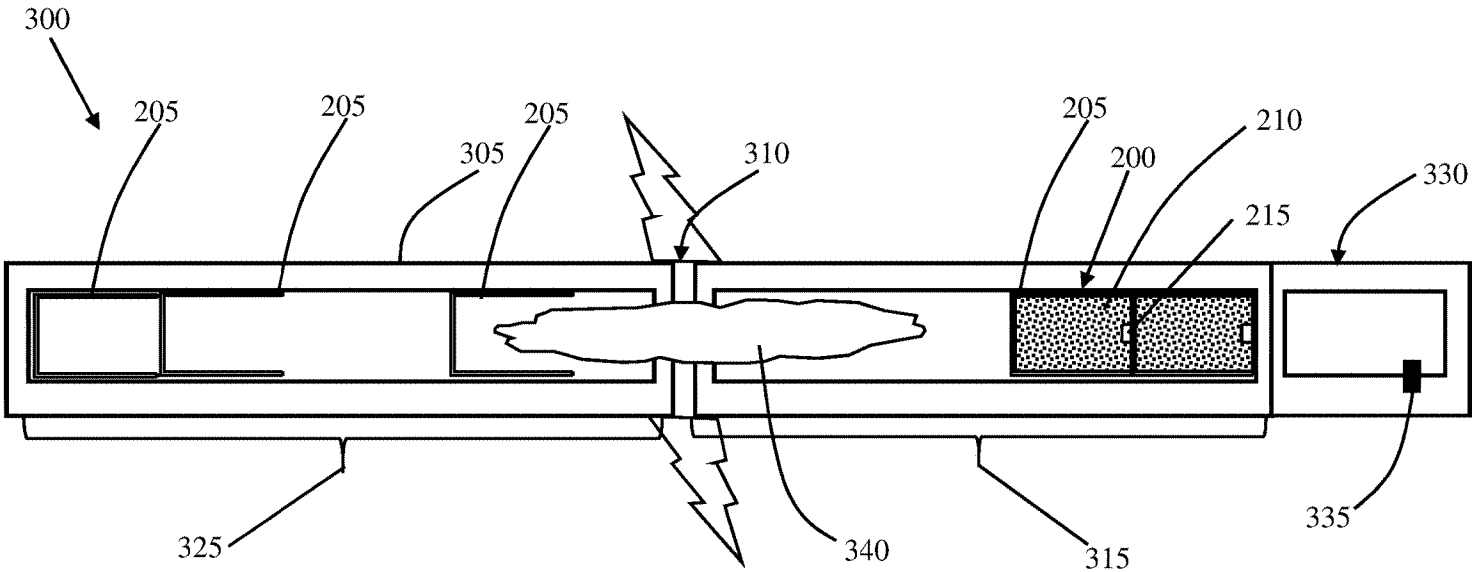
FIG. 3B illustrates a wellbore gas generation system after a number of stackable propellant modules have been ignited with the spent housings being ejected into a storage section of the wellbore gas generation system.

FIG. 3B shows the wellbore gas generation system 300 after the sequential ignition of multiple propellant modules 200. As seen, when the first propellant module 200 is ignited, the gas that is generated blows out through the vent hole 310. The ignition of the propellant 210 generates a high pressured gas 340 that exits the wellbore gas generation system 300 through the vent hole 310 to achieve a DOB, which aides in clean out debris in the fracture zone. As each of the propellant modules 200 are ignited, the spent housings 205 are ejected into the spent module housing storage section 325.

Figure 4:
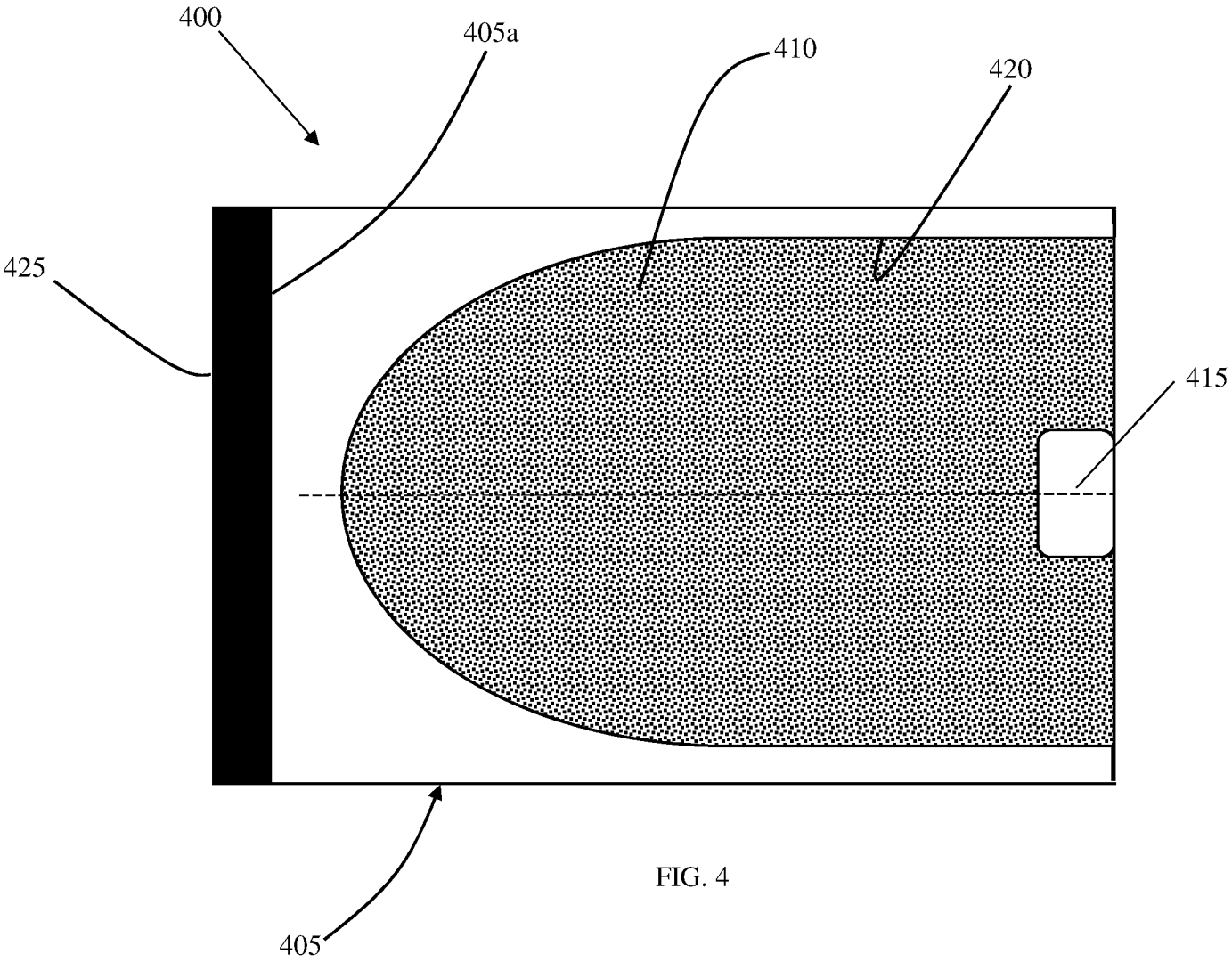
FIG. 4 illustrates an embodiment of a stackable propellant module.

FIG. 4 illustrates a sectional view of one embodiment of a propellant module 400 that may be used in the wellbore gas generation system 135. In this embodiment, the propellant module 400 comprises a housing 405 configured/designed to be inserted into a wellbore gas generation canister (not shown), a propellant 410 contained in the housing 405, and an igniter 415 associated with the housing 405 and positioned to ignite the propellant 410. In this embodiment, the housing 405 is comprised of a propellant, such as a reactive/consumable material that has a higher ignition point than an ignition point of the propellant 410. This embodiment provides the advantage of reducing space required to store a housing module within the gas generation system 135, as described above. Thus, this feature allows more propellant modules 400 to be stacked within the wellbore gas generation system 135, given that a substantial amount of the housing is consumed during the exothermic/explosive reaction. The propellant 410 that makes up the housing 405 is a relatively stiff propellant, which is sufficiently stiff to withstand the external pressure load. However, due to its higher ignition point, it will be more difficult to ignite and also be slower burning, but the benefit comes from the housing 405 being consumed during the reaction, thereby reducing the amount of debris, as mentioned above.

In one aspect of this embodiment, the propellant of the housing 405 has a lower porosity and lower surface area per volume than the propellant 415 that is located within the housing 405. In some embodiments, the housing 405 will have an arched interior 420 to add structural strength to the housing 405. In another embodiment, where the housing 405 is comprised of a propellant, the housing 405 further includes a thermal insulating layer 425 located on an end 405*a* of the housing 405 opposite the igniter 415, as generally shown. The thermal insulating layer 425 may be comprised of a pliable thermal plastic or frangible material, such as plaster. The insulating layer 425 protects the propellant module 400 from inadvertent ignition when an adjacent propellant module is ignited. In one embodiment, the propellant 410 fills a substantial portion of the hollow space of the housing 405, as generally shown. However, it should be noted that different amounts of propellant 410 may be used, depending on the amount of gas and corresponding pressure that is intended to be generated, and in such embodiments, the propellant 410 may fill less space within the housing 405. The propellant 410 and the propellant that comprise the housing 405 may be conventional explosives or propellants that are conventionally used to generate gas in wellbore applications.

The igniter 415 is associated with housing 405, that is, the igniter 415, or a portion thereof, may be contained within the housing 405 and embedded within the propellant 410, as shown, or in alternative embodiment, the igniter 415 may contact the propellant 410 while remaining outside of the housing 405. The igniter 415 can be used to ignite the propellant 410 in a variety of ways, such as through the use of electrical contacts or mechanical percussion. Thus, in some embodiments, the igniter 415 may simply be two electrical leads that extend into the propellant 410, or in another embodiment, it may be a detonator that forms a small explosion within the propellant 410, which then ignites the propellant 410. In one embodiment, the igniter 415 is located on a central axis and is embedded within the propellant, as generally shown in FIG. 4.

Figure 5A:
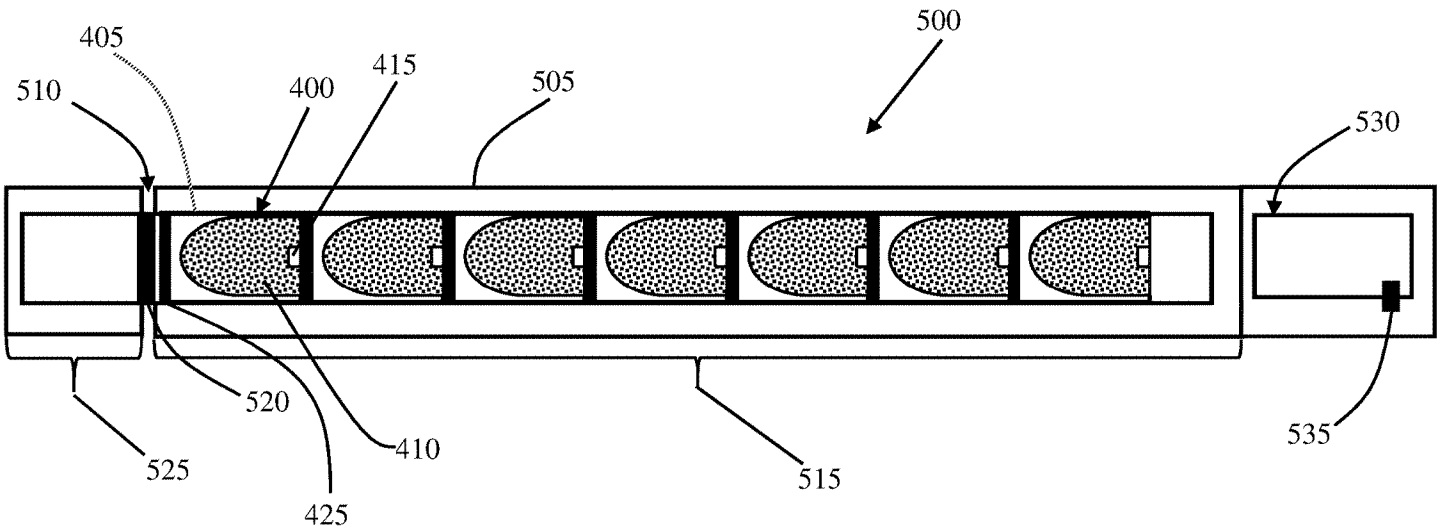
FIG. 5A illustrates a wellbore gas generation system in which an embodiment of the stackable propellant module may be implemented.

FIG. 5A illustrates an embodiment of a wellbore gas generation system 500 that uses embodiments of the propellant module of FIG. 4, only one of which is designated for simplicity of illustration. The depicted embodiment comprises a gas generation canister housing 505 having at least one or more vent holes 510 located along a length of the gas generation canister housing 505. In one embodiment, where only one vent hole 510 is present, it is located adjacent and end of the wellbore gas generation system 500. A number of the propellant modules 400 are positioned in a module storage section 515 uphole (as positioned in a wellbore) from a blow-open valve 520, such as a steel disk or puck, which plugs the vent hole 510 until the propellant 410 is ignited. This embodiment illustrates the wellbore gas generation system 500 prior to being placed in a wellbore. This embodiment also includes a spent module housing storage section 525 that is positioned to receive the thermal insulating layer 425 and any other debris not consumed in the ignition. When the wellbore gas generation system 500 is positioned in a wellbore, the spent module housing storage section 525 is located downhole from the vent hole 510.

In one embodiment, the wellbore gas generation system 500 includes an electronic control system 530 that may have a built in electrical power supply or an external power supply. The electronic control system 530 is electrically connected, either by hard wire of wireless, to the igniter 410 of each of the propellant modules 400 to facilitate transmission of the ignition signal. The igniters 415 of each of the propellant modules have a signal address that the controller system 530 uses to ignite each propellant module 400 individually. The electronic control system 530 is programmed to time the firing of each igniter 415 in real time as it assesses the wellbore pressure conditions. In this way the propellant modules 400 can be ripple fired with small, directed time delays between each module firing signal so that the desired wellbore pressure rise rate and time can be achieved.

Though the illustrated embodiment shows the electronic control system 530 coupled directly to the wellbore gas generation system 500, it should be understood that in other embodiments, the electronic control system 530 may be remotely coupled to wellbore gas generation system 500. For example, the electronic control system 530 may be located at the surface of the wellbore and be coupled to the wellbore gas generation system 500 by a wire running from the surface to the wellbore gas generation system 500, or they may be coupled wirelessly.

In one embodiment, the wellbore gas generation system 500 may also include a pressure senor 535 and other sensors, such as temperature sensors (not shown). The pressure sensor 535 is coupled to the electronic control system 530 and supplies pressure data to the electronic control system 530 that allows the electronic control system 530 to maintain the desired amount of pressure within the wellbore gas generation system 500.

Figure 5B:
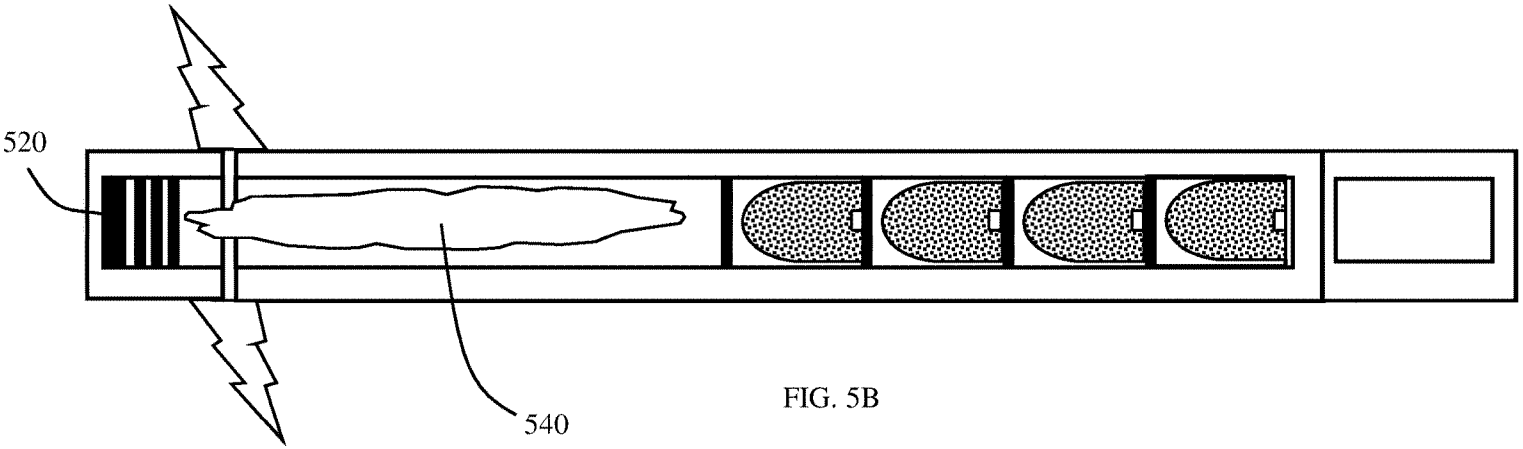
FIG. 5B illustrates a wellbore gas generation system after a number of stackable propellant modules have been ignited with at least a portion of the spent housings being ejected into a storage section of the wellbore gas generation system.

FIG. 5B shows the wellbore gas generation system 500 after the sequential ignition of multiple propellant modules 500. As seen, the blow-open valve 520 has been blown down to the end of the spent module housing storage section 525 by the ignition of the propellant 410. The ignition of the propellant 410 generates a high pressured gas 540 that exits the wellbore gas generation system 500 through the vent hole 510. After ignition of the standard propellant 410 in the propellant modules 400, the reactive housing 400 will be ignited on its inner surface by exposure to the hot reaction products, and the housing will also breakup as the internal pressure increases, thereby increasing the surface area of the housing and increasing its burn rate. As mentioned above, the thermal insulating layer 425 can either be a material that is pliable and remains intact throughout the reaction (e.g., a thick plastic wafer). Alternatively, it could be made of a material that is frangible (e.g., plaster of Paris), and in such cases, it will break up whenever an adjacent propellant module 400 is ignited. If plastic is chosen, then the thermal insulating layer 425 will remain after reaction and will be ejected into and stack up in the spent module housing storage section 525. If a frangible material is chose, then some or most of it may be ejected into the wellbore.

Embodiments herein comprise:

A propellant module for a wellbore gas generation canister. This embodiment comprises a housing configured to be inserted into a wellbore gas generation canister, a propellant contained in the housing and an igniter associated with the housing and positioned to ignite the propellant.

Another embodiment is directed to a wellbore gas generation system. This embodiment comprises a gas generation canister housing having at least one or more vent holes located along a length of the gas generation canister housing. One or more stackable propellant modules are located within a module storage section of the gas generation canister. Each of the stackable propellant modules comprises: a module housing configured to be inserted into the wellbore gas generation canister housing; a propellant contained in the module housing; and an igniter associated with the module housing and located adjacent a first end of the module housing and positioned to ignite the propellant.

Another embodiment is directed to a method of controlling a pressure ramp rate associated with a gas generation event in a wellbore. This embodiment comprises placing a perforating tool in the wellbore. The perforating tool has a lower end coupled to a wellbore gas generation canister system. The wellbore gas generation canister has one or more stackable propellant modules located therein. Each of the stackable propellant modules has an individually addressable igniter and a propellant contained within a module housing thereof. A casing of the wellbore is perforating using the perforating tool. Subsequent to the perforation, one or more of the stackable propellant modules is ignited in an addressable manner using a controller, wherein the controller sends an ignition signal to each of the addressable igniters in a time-delayed manner. At least a portion of the module housing of each of the one or more stackable propellant modules that is ignited is ejected into a spent module housing section of the wellbore gas generation canister system.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the non-propellant housing is comprised of metal or plastic.

Element 2: wherein the housing is comprised of a propellant having a higher ignition point than an ignition point of the propellant.

Element 3: wherein the propellant of the housing has a lower porosity and lower surface area per volume than the propellant located within the housing.

Element 4: wherein the housing has an arched interior.

Element 5: wherein the housing further comprises a thermal insulating layer located on an end of the housing opposite the igniter.

Element 6: wherein the igniter is located within the propellant and on a central axis of the housing.

Element 7: wherein the module housing is comprised of metal or plastic.

Element 8: wherein the gas generation canister housing further comprises a spent module housing storage section positioned to receive a module housing of the propellant module after ignition of the propellant, and the at least one vent hole is located at an axial center of the gas generation canister housing and between the module storage section and the spent module housing storage section.

Element 9: wherein the module housing is comprised of a propellant having a higher ignition point than an ignition point of the propellant.

Element 10: wherein the module housing is comprised of a propellant having a lower porosity and lower surface area per volume than the propellant located within the module housing.

Element 11: wherein the module housing has an arched interior.

Element 12: wherein the module housing further comprises a thermal insulating layer located at a second end of the module housing opposite the first end.

Element 13: wherein the gas generation canister housing further comprises a thermal insulating layer storage section located to receive the thermal insulating layers after ignition of the propellant and the at least one vent hole is located between the module storage section and the thermal insulating layer storage section.

Element 14: wherein the igniter is located within the propellant and on a central axis of the housing.

Element 15: wherein the gas generation canister further includes an electronic control system coupled to the igniter.

Element 16: wherein the gas generation canister further includes a pressure sensor.

Element 17: wherein the gas generation canister housing is coupled to a perforation tool.

Element 18: wherein the one or more vent holes includes a blow-open valve.

Element 19: wherein each of the module housings is comprised of a propellant having a higher ignition point than an ignition point of the propellant contained within the module housings, each of the module housings having a thermal insulating layer located on an end of the module housing opposite an end on which the addressable igniters is located, and ejecting includes ejecting the thermal insulating layer into the spent module housing section.

The foregoing listed embodiments and elements do not limit the disclosure to just those listed above, and those skilled in the art to which this application relates will appreciate that other and further additions, deletions, substitutions and modifications may be made to the described embodiments.

What is claimed is:

1. A method of controlling a pressure ramp rate associated with a gas generation event in a wellbore, comprising:

placing a perforating tool in a wellbore, said perforating tool coupled to a wellbore gas generation canister system having one or more linearly stackable propellant modules located therein, wherein each of said one or more stackable propellant modules has an individually addressable igniter and a propellant contained within a module housing thereof;

perforating a casing of said wellbore with said perforating tool; and subsequent to said perforating, igniting one or more of said linearly stackable propellant modules in an addressable manner using a controller wherein said controller sends an ignition signal to each of said addressable igniters in a time-delayed manner.

2. The method of claim 1, wherein each of said module housings is comprised of a propellant having a higher ignition point than an ignition point of said propellant contained within said module housings, each of said module housings having a thermal insulating layer located on an end of said module housing opposite an end on which said addressable igniters is located, and ejecting includes ejecting said thermal insulating layer into said spent module housing section.

3. The method of claim 1, further including ejecting at least a portion of said module housing of each of said one or more stackable propellant modules that is ignited.

4. The method of claim 3, wherein ejecting includes ejecting at least a portion of said module housing of each of said one or more stackable propellant modules that is ignited into a spent module housing section of said wellbore gas generation canister system.

5. The method of claim 4, wherein ejecting at least a portion of said module housing includes longitudinally sliding the at least a portion of said module housing.

6. The method of claim 1, wherein the gas generation canister housing has at least one or more vent holes located along a length thereof.

7. The method of claim 6, wherein said igniting one or more of said linearly stackable propellant modules in an addressable manner causes pressurized gas to exit the at least one or more vent holes and into the wellbore.

8. The method of claim 1, wherein each of said module housings is comprised of a propellant having a lower porosity and lower surface area per volume than said propellant located within said module housing.

9. The method of claim 1, wherein each of said igniters is located within each of said propellants and on a central axis of each of said housings.

10. The method of claim 1, wherein said gas generation canister further includes an electronic control system coupled to each of said igniters.

11. The method of claim 1, wherein said gas generation canister further includes a pressure sensor.

12. The method of claim 1, wherein said controller is configured to receive pressure readings from a pressure sensor and time a firing of the one or more linearly stackable propellant modules in real time.

13. The method of claim 1, wherein said controller fires the one or more linearly stackable propellant modules with time delays so that a desired wellbore pressure ramp rate can be achieved.

14. The method of claim 1, wherein said controller fires the one or more linearly stackable propellant modules with time delays so that a final desired wellbore pressure is achieved.

15. A method of controlling a pressure ramp rate associated with a gas generation event in a wellbore, comprising:

placing a perforating tool in a wellbore, said perforating tool coupled to a wellbore gas generation canister system having one or more linearly stackable propellant modules located therein, wherein each of said one or more stackable propellant modules has an igniter and a propellant contained within a module housing thereof;

perforating a casing of said wellbore with said perforating tool; and subsequent to said perforating, igniting one or more of said linearly stackable propellant modules, the igniting causing a module housing of the ignited linear stackable propellant modules to linearly slide within the wellbore gas generation canister.

16. The method of claim 15, wherein the igniting causes the module housing of the ignited linear stackable propellant modules to linearly slide into a spent module housing section of said wellbore gas generation canister system.

17. The method of claim 16, wherein the ignitor is an individually addressable ignitor and further wherein each of said module housings is comprised of a propellant having a higher ignition point than an ignition point of said propellant contained within said module housings, each of said module housings having a thermal insulating layer located on an end of said module housing opposite an end on which said addressable ignitor is located, and linearly sliding includes linearly sliding said thermal insulating layer.

18. The method of claim 15, wherein the gas generation canister housing has at least one or more vent holes located along a length thereof.

19. The method of claim 18, wherein said igniting one or more of said linearly stackable propellant modules causes pressurized gas to exit the at least one or more vent holes and into the wellbore.

20. The method of claim 15, wherein each of said module housings is comprised of a propellant having a lower porosity and lower surface area per volume than said propellant located within said module housing.

21. The method of claim 15, wherein each of said igniters is located within each of said propellants and on a central axis of each of said housings.

22. The method of claim 15, wherein said gas generation canister further includes an electronic control system coupled to each of said igniters.

23. The method of claim 15, wherein said gas generation canister further includes a pressure sensor.

* * * * *